US006401343B1

(12) United States Patent
Hsu

(10) Patent No.: US 6,401,343 B1
(45) Date of Patent: Jun. 11, 2002

(54) WAVED-EDGE CUTTER

(75) Inventor: Walter Hsu, Yinlin Hsien (TW)

(73) Assignee: Welter's Co., Ltd., Yinlin Hsien (TW)

( * ) Notice: Subject to any disclaimer, the term of this patent is extended or adjusted under 35 U.S.C. 154(b) by 0 days.

(21) Appl. No.: 09/842,718

(22) Filed: Apr. 27, 2001

(51) Int. Cl.[7] ..... B26B 1/00
(52) U.S. Cl. ..... 30/293; 30/294; 83/745
(58) Field of Search ..... 30/293, 294, 286; 83/745, 743

(56) References Cited

U.S. PATENT DOCUMENTS

| | | | | | |
|---|---|---|---|---|---|
| 3,407,498 | A | * | 10/1968 | Young | 30/293 |
| 4,125,942 | A | * | 11/1978 | Horner et al. | 83/745 X |
| 4,176,572 | A | * | 12/1979 | Pennington | 83/745 X |
| 4,195,406 | A | * | 4/1980 | Lackey | 30/293 X |
| 5,035,061 | A | * | 7/1991 | Bradbury et al. | 83/745 X |
| 5,083,375 | A | * | 1/1992 | Helm | 30/294 |
| 5,946,808 | A | * | 9/1999 | Martinez | 83/745 X |

* cited by examiner

*Primary Examiner*—Douglas D. Watts
(74) *Attorney, Agent, or Firm*—Bacon & Thomas, PLLC

(57) ABSTRACT

Waved-edge cutter which is co-used with a waved-edge mold plate. The waved-edge cutter includes a base seat, an adjustment bar, an upper cover, a blade seat, a blade bit, a restoring spring, an adjustment collar, a clip member, a fitting cap, a locating button and a locating screw. A front section of the adjustment bar is connected with the blade seat. The lower end of the blade seat is connected with the blade bit. The restoring spring is received in the blade seat. The upper end of the blade seat is locked with the adjustment collar. The clip member is received in the top of the adjustment collar which is fitted with the fitting cap. The middle or rear section of the adjustment bar rides on the adjustment channel of the base seat. One of the marks of the top face, which is identical to the sculptured mark of the waved-edge mold plate, is aligned with the standard point of the base seat. The locating screw is locked with the locating button to fix the adjustment bar. The locating legs of the base seat are inserted and located in the rail slot of the waved-edge mold plate for stably, conveniently and truly cutting the paper with various types of waved curves, patterns and shapes.

5 Claims, 3 Drawing Sheets

WAVED-EDGE CUTTER

BACKGROUND OF THE INVENTION

The present invention is related to a waved-edge cutter which is co-used with a waved-edge mold plate. Any of the sculptured marks of the adjustment bar can be freely selected as personally desired and the adjustment bar can be adjusted to align the sculptured mark with the standard point of the base seat. The locating legs of the base seat are inserted and located in the rail slot of the waved-edge mold plate and stably and firmly located at two points. The stabilizing wings of the base seat are attached to the waved-edge mold plate for stably and conveniently and truly cutting the paper with waved curves the same as the waved rail slot.

A conventional waved-edge scissors is used to cut a paper with waved edges. The blade of such waved-edge scissors has a short length. Therefore, in the case that the length of a paper is much longer than the length of the blade of the waved-edge scissors, it will be necessary to repeatedly scissor the paper. Such procedure is troublesome and time-consuming. Moreover, when secondarily scissoring the paper, it is hard to align the waved-edge scissors with the previously cut waved edge. Therefore, it often takes place that a waved edge fails to be flush with the other and an irregular curve is produced. Furthermore, the waved-edge scissors can only scissor the paper with a fixed pattern of waved edge. When it is desired to scissor the paper with various types of waved edges, a user must purchase many kinds of waved-edge scissors with different patterns of waved edge. This increases cost for the waved-edge scissors.

SUMMARY OF THE INVENTION

It is therefore a primary object of the present invention to provide a waved-edge cutter. When cutting the paper, any of the sculptured marks of the waved-edge mold plate can be freely selected as personally desired and the adjustment bar can be adjusted back and forth to align the sculptured mark of the top face which is identical to the previously selected sculptured mark of the waved-edge mold plate with the standard point of the base seat. With one waved-edge mold plate, the paper can be cut with various types of waved curves, patterns and shapes.

It is a further object of the present invention to provide the above waved-edge cutter in which when the waved-edge cutter is placed in the rail slot of the waved-edge mold plate, the locating legs on two sides of the base seat are respectively inserted into the desired rail slots of the waved-edge mold plate. The two locating legs are stably and firmly located at two points so that the paper can be stably and smoothly cut with a waved curve identical to the rail slot without deflection.

It is still a further object of the present invention to provide the above waved-edge cutter in which a user's hand can hold the holding recesses of the stabilizing wings of the base seat and the stabilizing wings of two sides of the base seat are attached to the waved-edge mold plate, whereby the paper can be stably, conveniently and truly cut with a waved curve without deflecting or derailing.

It is still a further object of the present invention to provide the above waved-edge cutter in which the adjustment collar can be turned to change the resilience of the restoring spring. Therefore, the resilient tolerance of the blade bit 31 can be properly changed for suitably cutting papers with different thickness and materials.

It is still a further object of the present invention to provide the above waved-edge cutter in which the waviness of all the rail slots of the waved-edge mold plate is in proportion to the distance between the two locating legs of the base seat so that the two locating legs are both inserted and located on the same waviness of the rail slot. In the case that the paper has a length longer than that of the rail slot and a secondary cutting is necessary, each cut curve will be flush with the other to achieve a smooth cut curve.

It is still a further object of the present invention to provide the above waved-edge cutter in which by means of the clip member and the fitting cap, various kinds of blade bits with different functions are replaceable in accordance with the change of waviness of the rail slots of the waved-edge mold plate. Therefore, the blade bits can be more mobilely used and conveniently replaced and the cutting can be completed without turning the paper.

The present invention can be best understood through the following description and accompanying drawings wherein:

DETAILED DESCRIPTION OF THE PREFERRED EMBODIMENT

Figure 1:
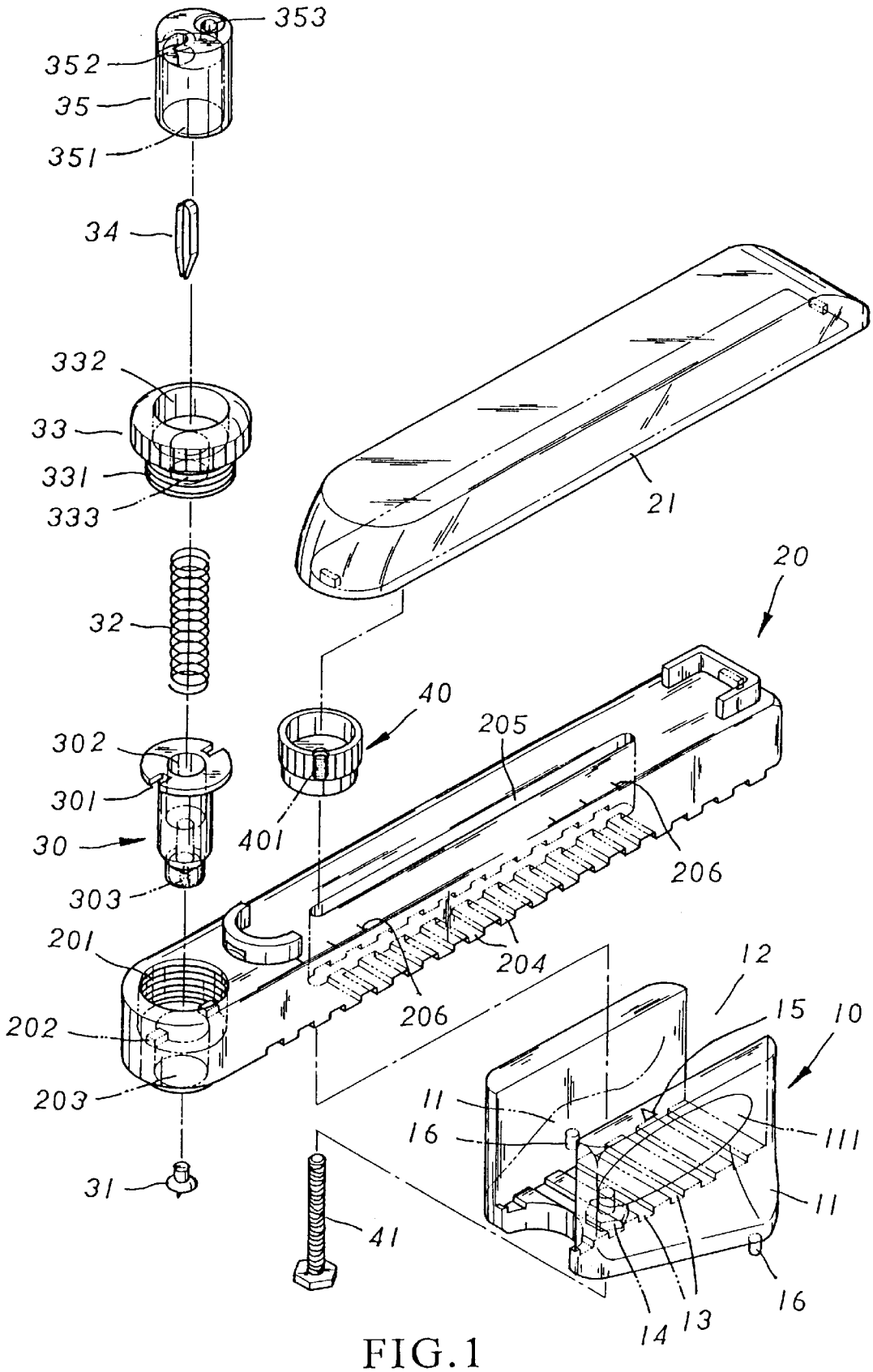
FIG. 1 is a perspective exploded view of the present invention.

Please refer to FIG. 1. The waved-edge cutter of the present invention is co-used with a waved-edge mold plate 50 having several curved rail slots 52 with different waviness. The waved-edge cutter is composed of a base seat 10, an adjustment bar 20, an upper cover 21, a blade seat 30, a blade bit 31, a restoring spring 32, an adjustment collar 33, a clip member 34, a fitting cap 35, a locating button 40 and a locating screw 41. The base seat 10 has two stabilizing wings 11 outward and downward extending from left and right sides of the base seat 10. The upper portion of the stabilizing wing 11 is formed with a holding recess 111 for a hand to hold. The middle of upper side of the base seat 10 is formed with an adjustment channel 12 with a certain depth and width for the adjustment bar 20 to ride thereon. The bottom of the base seat 10 is formed with several locating flutes 13 at equal intervals. The middle of the front locating flute 13 is formed with a thread hole 14. The front end face is formed with an arch escape notch. A standard point 15 is disposed on one side of the adjustment channel 12 at the middle of top face of one stabilizing wing 11. Two locating legs 16 are disposed on two lateral sides of bottom face of the base seat 10 and spaced from the center by a certain distance. The adjustment bar 20 is an elongated bar body with a certain thickness and a certain width. The front section thereof is formed with a blind thread hole 201 with a certain depth for the adjustment collar 34 to lock therein. The bottom of the thread hole 201 is formed with two opposite engaging blocks 202. The center is formed with an insertion hole 203. The bottom face of the middle and rear sections of the adjustment bar 20 is formed with several locating ribs 204 at equal intervals corresponding to the locating flutes 13 of the base seat 10. (The distance between each two locating ribs 204 is determined by the distance between the rail slots 52 of the waved-edge mold plate 50.)

The center is formed with a long slot 205. The top face is sculptured with several marks 206 at equal intervals on one side of the long slot 205. The distance between each two marks 206 is equal to the distance between each two locating ribs 204 or each two rail slots 52. The front and rear sides are formed with stop walls. The outer edge of the stop wall is formed with an engaging mortise for mating and engaging with the upper cover 21. The inner sides of front and rear ends of the upper cover are formed with engaging tenons corresponding to the engaging mortises of the adjustment bar 20. The upper end of the blade seat 30 is formed with a circular flange having two opposite cuts 301. The center of upper section is formed with a socket 302 for receiving the restoring spring 32 therein. The lower end is provided with a bearing having a central engaging hole 303. The blade bit 31 is a short cylindrical body one end of which is formed with an enlarged stop plate with a certain thickness. A blade is inlaid in the center of the stop plate. The adjustment collar 33 is a T-shaped member having a large diameter section and a small diameter section. The circumference of the large diameter section is formed with slipproof stripes. The small diameter section is formed with outer thread section 331. The top section is formed with a receptacle 332 for receiving therein the clip member 34. The bottom is formed with cavity 333. The fitting cap 35 is a cylindrical barrel body having an opening facing downward. The center thereof is formed with a receiving chamber 351. One side of top face is formed with a blade extracting cave 352. The other side is formed with a stepped locating hole 353. The locating button 40 is a cylindrical body. The circumference of upper section is formed with slipproof stripes. The bottom face is formed with a thread hole 401. The front side of the waved-edge mold plate 50 is formed with a long guide slot 51. Several rail slots 52 with different waviness are formed behind the guide slot 51 at equal intervals. The waviness of all the rail slots 52 is in proportion to the distance between the two locating legs 16 of the base seat 10. One side of each rail slot 52 is sculptured with marks the same as the waved rail slot 52.

Figure 2:
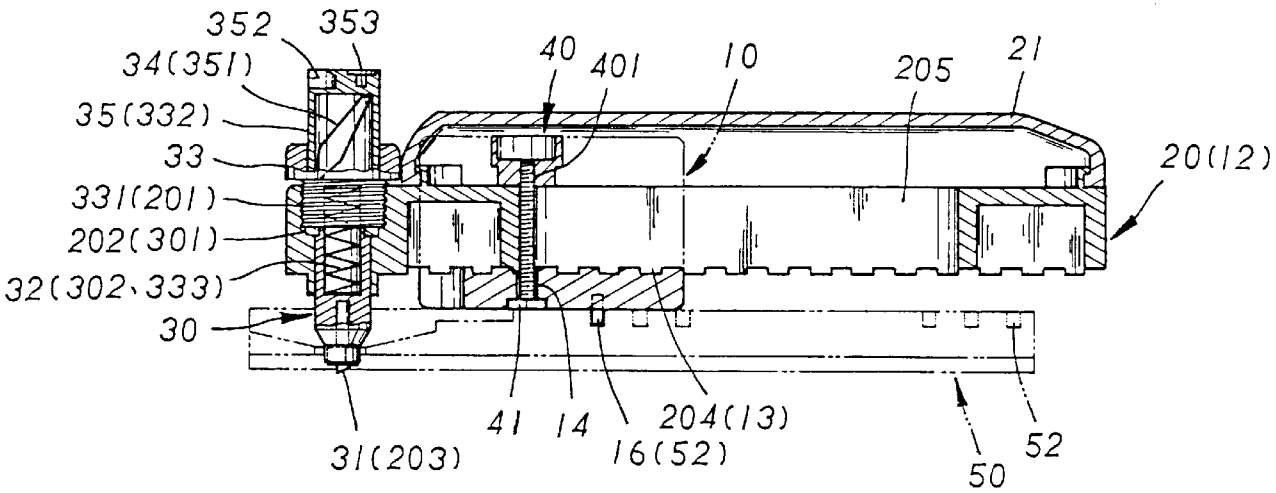
FIG. 2 is a sectional assembled view of the present invention.
Figure 3:
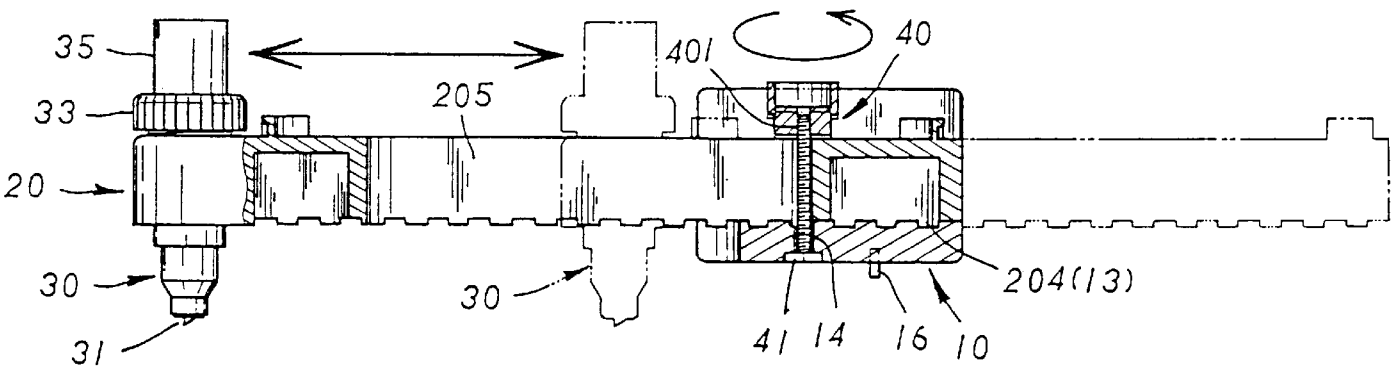
FIG. 3 is a sectional view showing the adjustment of length of the present invention.

When assembled, as shown in FIG. 2, the blade seat 30 is first inserted into the insertion hole 203 of the adjustment bar 20 with the engaging blocks 202 engaged with the engaging cuts 301. The blade bit 31 is clipped with the clip member 34 and placed into the locating hole 353 of top face of the fitting cap 35 with the short cylindrical body protruding outward. Then, with the fitting cap 35, the short cylindrical body is inserted and engaged in the engaging hole 303 of the blade seat 30. At this time, the stop plate of the blade bit 31 and the blade seat 30 define therebetween an extraction gap. The central axis is eccentric from the end section of the blade of the blade bit 31, whereby the blade bit 31 can be swung. The restoring spring 32 is placed into the socket 302 of the blade seat 30 and the outer thread section 331 of the adjustment collar 33 is screwed into the thread hole 201 of the adjustment bar 20 with the bottom. face abutting against the top face of the blade seat 30 to compress the restoring spring 32 to a certain extent. At this time, the adjustment collar 33 can be screwed up and down to change the resilience of the restoring spring 32. Therefore, the blade bit 31 can have a considerable resilient tolerance. The receptacle 332 of the adjustment collar 33 receives the clip member 34 therein. The lower section of the fitting cap 35 is fitted into the receptacle 332. The middle or rear section of the adjustment bar 20 rides on the adjustment channel 12 of the base seat 10 with the locating ribs 204 of bottom face of the adjustment bar 20 engaged with the locating flutes 13 of the base seat 10. One of the marks 206 of the top face is aligned with the standard point 15 of the base seat 10. The locating screw 41 is passed through the thread hole 14 of the base seat 10 and the long slot 205 of the adjustment bar 20 and locked with the locating button 40. The base seat 10, locating button 40 and locating screw 41 clamp and fix the adjustment bar 20. By means of unscrewing the locating button 40 and the locating screw 41, the locating ribs 204 can be back and forth moved on the locating flutes 13 of the base seat 10 along the long slot 205 for adjusting the length as shown in FIG. 3. Finally, the upper cover 21 is mated with the adjustment bar 20 to cover the same to form the waved-edge cutter.

Figure 4:
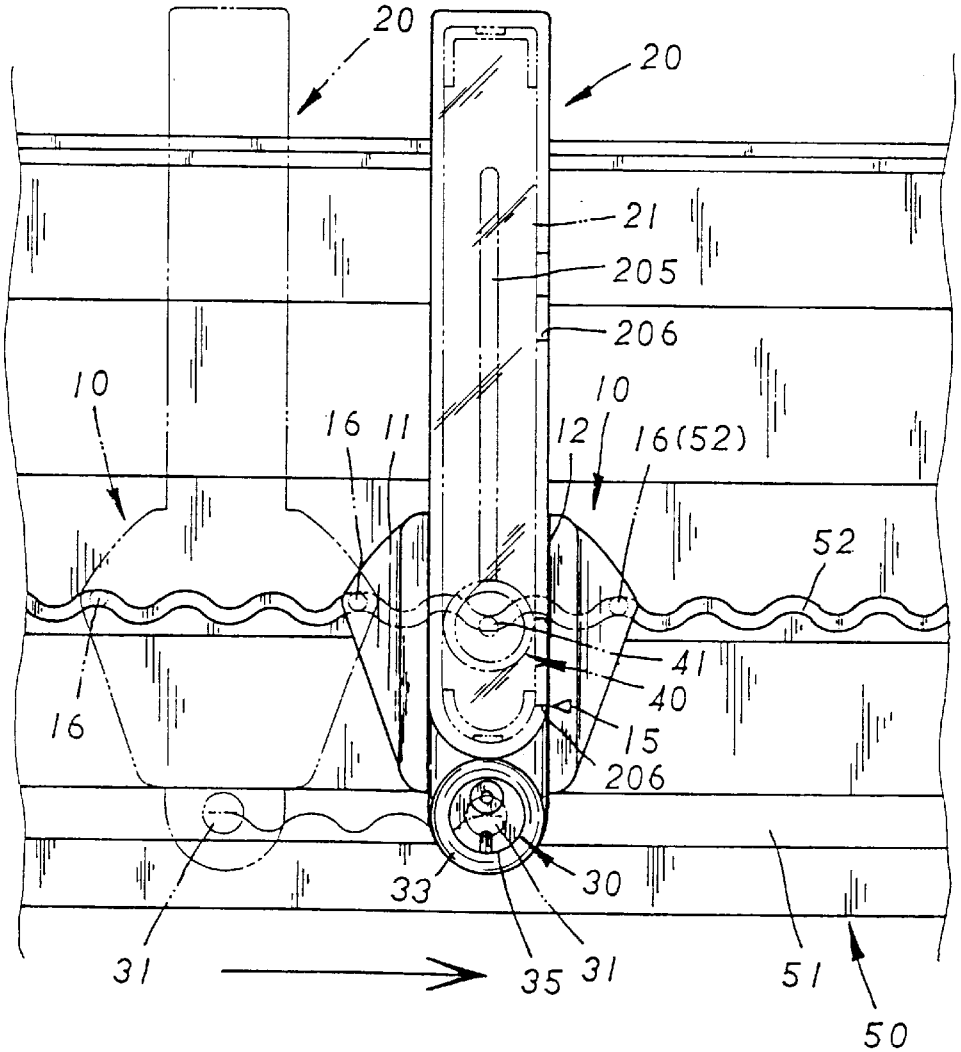
FIG. 4 is a top view of the present invention, showing that the waved-edge cutter of the present invention is co-used with a waved-edge mold plate for cutting a paper.

When cutting a paper, as shown in FIGS. 2 and 4, the upper cover 21 is first removed and a sculptured mark with desired waviness of the waved-edge mold plate 50 is selected. Then, the locating button 40 and the locating screw 41 are unscrewed, permitting the adjustment bar 20 to be adjusted with the locating ribs 204 moved back and forth on the locating flutes 13 of the base seat 10 along the long slot 205. The sculptured mark 206 of the top face which is identical to the previously selected sculptured mark of the waved-edge mold plate 50 is aligned with and located at the standard point 15 of the base seat 10. Then, the locating button 40 and the locating screw 41 are tightened to lock the adjustment bar 20. The upper cover 21 is again mated with the adjustment bar 20. Then, the locating legs 16 on two sides of the base seat 10 are respectively inserted into the desired rail slots 52 of the waved-edge mold plate 50. The waviness of all the rail slots 52 is in proportion to the distance between the two locating legs 16 of the base seat 10 so that the two locating legs 16 are both inserted and located on the same waviness of the rail slot 52. Therefore, the two locating legs 16 are stably and firmly located at two points. In addition, the stabilizing wings 11 of two sides of the base seat 10 are attached to the waved-edge mold plate 50, whereby when cutting the paper, the waved-edge cutter is stably located without deflecting and derailing. Also, the blade bit 31 is right received in the guide slot 51 of front side of the mold plate 50. Then, a user's hand can hold the holding recesses 111 of the stabilizing wings 11 of the base seat 10 and move the locating legs 16 along the rail slot 52 of the mold plate 50 to cut the paper with a waved curve the same as the rail slot 52. When it is desired to cut the paper with another waved curve different from the rail slot 52, the adjustment bar 20 can be adjusted back and forth to align the desired sculptured mark 206 with the standard point 15 of the base seat 10. Also, the locating legs 16 of the base seat 10 are inserted and located in the rail slot 52 the same as the sculptured mark. Accordingly, the paper can be cut with various types of waved curves.

According to the above arrangement, the present invention has the following advantages:

1. When cutting the paper, any of the sculptured marks of the waved-edge mold plate 50 can be freely selected as personally desired. The locating button 40 and the locating screw 41 are unscrewed, whereby the adjustment bar 20 can be adjusted with the locating ribs 204 moved back and forth on the locating flutes 13 of the base seat 10 along the long slot 205. The sculptured mark 206 of the top face which is identical to the previously selected sculptured mark of the waved-edge mold plate 50 is aligned with and located at the standard point 15 of the base seat 10. With one waved-edge mold plate 50, the paper can be cut with various types of waved curves, patterns and shapes.
2. When the waved-edge cutter is placed in the rail slot 52 of the waved-edge mold plate 50, the locating legs 16 on two sides of the base seat 10 are respectively inserted into the desired rail slots 52 of the waved-edge mold plate 50. The two locating legs 16 are stably and firmly located at two points so that the paper can be stably and smoothly cut with a waved curve identical to the rail slot 52 without deflection.

3. A user's hand can hold the holding recesses 111 of the stabilizing wings 11 of the base seat 10 and the stabilizing wings 11 of two sides of the base seat 10 are attached to the waved-edge mold plate 50, whereby the paper can be stably, conveniently and truly cut with a waved curve. Even if the hand exerts a too great or too little force onto the cutter, the cutter still will not deflect or derail.
4. The adjustment collar 33 can be turned to change the resilience of the restoring spring. Therefore, the resilient tolerance of the blade bit 31 can be properly changed for suitably cutting papers with different thickness and materials.
5. The waviness of all the rail slots 52 of the waved-edge mold plate 50 is in proportion to the distance between the two locating legs 16 of the base seat 10 so that the two locating legs 16 are both inserted and located on the same waviness of the rail slot 52. In the case that the paper has a length longer than that of the rail slot 52 and a secondary cutting is necessary, each cut curve will be flush with the other to achieve a smooth cut curve.
6. By means of the clip member 34 and the fitting cap 35, various kinds of blade bits with different functions are replaceable in accordance with the change of waviness of the rail slots 52 of the waved-edge mold plate 50. Therefore, the blade bits can be more mobilely used and conveniently replaced and the cutting can be completed without turning the paper.

The above embodiment is only used to illustrate the present invention, not intended to limit the scope thereof. Many modifications of the above embodiment can be made without departing from the spirit of the present invention.

What is claimed is:

1. Waved-edge cutter which is co-used with a waved-edge mold plate, the waved-edge cutter comprising a base seat, an adjustment bar, an upper cover, a blade seat, a blade bit, a restoring spring, an adjustment collar, a clip member, a fitting cap, a locating button and a locating screw, said cutter being characterized in that:

the base seat has two stabilizing wings outward and downward extending from left and right sides of the base seat, the upper portion of each stabilizing wing being formed with a holding recess, the middle of upper side of the base seat being formed with an adjustment channel, the bottom of the base seat being formed with several locating flutes at equal intervals, the middle of the front side being formed with a thread hole, a standard point being disposed on one side of the adjustment channel at the middle of top face of one stabilizing wing, two locating legs being disposed on two lateral sides of bottom face of the base seat;

the adjustment bar is an elongated bar body with a certain thickness and a certain width, a front section thereof being connected with the blade seat and the blade bit, the bottom face of the middle and rear sections of the adjustment bar being formed with several locating ribs at equal intervals corresponding to the locating flutes of the base seat, the center being formed with a long slot, the top face being sculptured with several marks at equal intervals on one side of the long slot, the front and rear sides being formed with stop walls, the outer edge of the stop wall being formed with an engaging mortise;

inner sides of front and rear ends of the upper cover are formed with engaging tenons corresponding to the engaging mortises of the adjustment bar;

the locating button is a cylindrical body, the circumference of upper section thereof being formed with slipproof stripes, the bottom face being formed with a thread hole; and the middle or rear section of the adjustment bar rides on the adjustment channel of the base seat, the locating screw being passed through the thread hole of the base seat and the long slot of the adjustment bar and locked with the locating button, whereby the base seat, locating button and locating screw clamp and fix the adjustment bar and any of the sculptured marks of the waved-edge mold plate be freely selected as personally desired and the adjustment bar can be adjusted with the locating ribs moved back and forth on the locating flutes of the base seat along the long slot, the sculptured mark of the top face which is identical to the previously selected sculptured mark of the waved-edge mold plate being aligned with and located at the standard point of the base seat, the two locating legs being inserted and located in the rail slot of the waved-edge mold plate and stably and firmly located at two points, the stabilizing wings of the base seat being attached to the waved-edge mold plate for stably and conveniently and truly cutting the paper.

2. Waved-edge cutter as claimed in claim 1, wherein the front side of the waved-edge mold plate is formed with a long guide slot, several rail slots with different waviness being formed behind the guide slot at equal intervals, the waviness of all the rail slots being in proportion to the distance between the two locating legs of the base seat, one side of each rail slot being sculptured with marks the same as the waved rail slot.

3. Waved-edge cutter as claimed in claim 1 or 2, wherein the distance between each two locating ribs of the adjustment bar is determined by the distance between the rail slots of the waved-edge mold plate.

4. Waved-edge cutter as claimed in claim 1 or 2, wherein the distance between each two marks of top face of the adjustment bar is equal to the distance between each two locating ribs or each two rail slots.

5. Waved-edge cutter as claimed in claim 1, wherein the front section of the adjustment bar is formed with a blind thread hole with a certain depth, the bottom of the thread hole being formed with two opposite engaging blocks, the center being formed with an insertion hole, the upper end of the blade seat being formed with a circular flange having two opposite cuts, the center of upper section being formed with a socket, the lower end being provided with a bearing having a central engaging hole, the blade bit being a short cylindrical body one end of which is formed with an enlarged stop plate with a certain thickness, a blade being inlaid in the center of the stop plate, the adjustment collar being a T-shaped member having a large diameter section and a small diameter section, the circumference of the large diameter section being formed with slipproof stripes, the small diameter section being formed with outer thread section, the top section being formed with a receptacle, the bottom being formed with a cavity, the fitting cap being a cylindrical barrel body having an opening facing downward, the center thereof being formed with a receiving chamber, one side of top face being formed with a blade extracting cave, the other side being formed with a stepped locating hole, the blade seat being fitted in the insertion hole of the adjustment bar, the lower end of the blade seat being connected with the blade bit, the restoring spring being received in the center of the blade seat, the upper end of the blade seat being locked with the adjustment collar to compress the restoring spring to a certain extent, whereby by means of screwing the adjustment collar up and down, the resilience of the restoring spring can be changed and the blade bit can have a considerable resilient tolerance to suitably cut various kinds of papers having different thickness and made of different materials, by means of the clip member and the fitting cap, various kinds of blade bits with different functions being replaceable in accordance with the change of waviness of the rail slots of the waved-edge mold plate.

* * * * *